United States Patent [19]

Hannig

[11] 3,945,423

[45] Mar. 23, 1976

[54] METHOD FOR THE MANUFACTURE OF A COMPOUND CASTING

[75] Inventor: Christoph Hannig, Stuttgart, Germany

[73] Assignee: Mahle GmbH, Stuttgart, Germany

[22] Filed: Sept. 4, 1974

[21] Appl. No.: 503,134

[30] Foreign Application Priority Data

Sept. 6, 1973 Germany ..... 2344899

[52] U.S. Cl. ..... 164/75; 164/91; 164/98; 164/94; 164/100; 164/111

[51] Int. Cl.[2] ..... B22D 19/08

[58] Field of Search ..... 164/75, 91, 98, 102, 111, 164/94, 100; 204/38 S

[56] References Cited

UNITED STATES PATENTS

| | | | |
|---|---|---|---|
| 2,453,772 | 11/1948 | Whitfield et al. | 164/75 |
| 2,544,671 | 3/1951 | Grange et al. | 164/75 X |
| 2,634,469 | 4/1953 | Pershing et al. | 164/75 X |
| 2,672,666 | 3/1954 | Enfer et al. | 164/75 X |
| 2,800,707 | 7/1957 | Whitfield et al. | 204/38 S X |
| 2,974,380 | 3/1961 | Jominy | 164/102 |
| 3,064,112 | 11/1962 | Hanzel | 164/98 X |
| 3,225,400 | 12/1965 | Buschow | 164/102 |
| 3,730,758 | 5/1973 | Laidman | 204/38 S X |

FOREIGN PATENTS OR APPLICATIONS

| | | | |
|---|---|---|---|
| 1,282,243 | 11/1968 | Germany | 164/98 |
| 203,188 | 7/1965 | Sweden | 164/98 |

*Primary Examiner*—Ronald J. Shore
*Attorney, Agent, or Firm*—William Anthony Drucker

[57] ABSTRACT

A composite casting is produced by electrodepositing a wear resistance material onto a core, immersing the core in an aluminium melt and then casting an aluminium alloy around the core, before detaching the latter. The wear resistant layer may be given a roughened surface before immersing in the aluminium melt, by increasing the current density in the later stages of the depositing. The method may be used for casting light metal cylinders for internal combustion engines.

4 Claims, No Drawings

METHOD FOR THE MANUFACTURE OF A COMPOUND CASTING

BACKGROUND OF THE INVENTION

The invention relates to a method for the manufacture of a composite casting from an aluminium alloy and a wear-resistant material, the latter being applied onto a core, which can be detached from the finished compound casting and where, after immersion in an aluminium melt, which is necessary for the formation of an intermetallically combined, thin aluminium coating, the aluminium alloy is cast around the material in a pressureless manner.

It is known for example from German Pat. No. 1,291,865, to spray a layer of steel on a core and then to cast aluminium around this layer by the die-casting method. The connection between the aluminium and the steel layer occurs in a purely mechanical manner. When cooling down, the solidifying aluminium shrinks onto the coated core and is clamped, during this process, with the rough sprayed layer. Therefore, this method is only successful if the surface of the layer applied to the core has a sufficient roughness and if the aluminium is introduced into the casting mould under great pressure. For these reasons, the method is dependent on rough layers and is confined, for the rest, to the application of aluminium layers by the die-casting method. However, these limitations are decidedly a hindrance in some cases of use. For example, light-metal cylinders for internal combustion engines are manufactured predominantly by the low-pressure casting and chill casting methods. However, for these casting methods, too, ways have already been found for the manufacture of the abovementioned compound castings. In this connection, use has been made of the realization that intermetallic compound layers may form between superimposed layers of aluminium and steel, at the boundary surfaces thereof. A relatively strong adhesive bond between the superimposed layers can be brought about by these compound layers. The manufacture of such compound castings is described in detail, for example, in German Pat. No. 860,303 or German Pat. No. 971,052. These methods have also become known under the title A1-Fin method.

However, satisfactory adhesive strengths can only be achieved with this method of coating under very specific conditions, and because of these its application is again only possible within corresponding limits. For example, it is no longer possible to bring about a secure connection if oxides are present on one of the adjacent boundary surfaces. For, in this case, due to the very great affinity of aluminium relative to oxygen, the desired metallic compound is virtually prevented from the outset by the formation of an aluminium oxide layer. Therefore, the A1-Fin methods are performed in such a way that the part which is to be coated with aluminium is, first of all, immersed in an aluminium bath for a short time. In this manner, one obtains a thin aluminium coating which is intermetallically combined with the steel part that is to be coated. Due to the immersion of the part that is to be coated in a liquid aluminium melt, it is almost impossible for the aluminium to combine with the oxygen of the air on the surface that is to be coated. Attention has to be paid, too, that there is not any free or combined oxygen present in the surface of the part that is to be coated, which might lead to the formation of an oxide layer in the aluminium that is to be applied.

To this extent, it seems that parts with rough and porous surfaces, as found particularly on thermically sprayed metal layers, have hitherto been uncoatable by the A1-Fin method. After all, the oxide content in metal spray layers is easily up to 60 %. Of course, theoretically it would be possible to eliminate to a very large extent the problems caused by oxidation by working under a vacuum or in a protective gas atmosphere, that is to say in this case they would not arise in the first place. However, this would also apply to metal spraying and the introduction of the sprayed layer into the aluminium bath. However, for economic reasons alone, it is not possible to take this course of action in practice.

According to the prior art, it has therefore hitherto only been possible to keep the surfaces of the parts to be coated with aluminium free from oxide and then to coat them by the A1-Fin method or else to apply the aluminium layer by the die-casting method, in which case one had to be content with a mechanical bonding of the adjoining materials. It is a great disadvantage that the application of the A1-Fin method is confined to parts which have entirely or at least substantially oxide-free surfaces. Attempts have been made to eliminate this disadvantage partly be subsequently removing the surfaces containing oxides, which can be done for example by mechanical methods such as sand rays or other material removing treatment processes.

Very special problems, which can usually hardly be solved, emerge in this respect in the case of layers which are manufactured by the metal spraying method and which have to be coated with aluminium according to the A1-Fin method, because of the extremely high oxide content in such layers.

OBJECT OF THE INVENTION

It is the object of this invention to eliminate the circumstances which limit the possibility of applying the A1-Fin method or which render its application very difficult. Special emphasis is laid on the point that the parts that are to be coated can be made available to the A1-Fin process without receiving any surface-removing mechanical pre-treatment.

SUMMARY OF THE INVENTION

According to the invention there is provided a method for manufacturing a composite casting, comprising the steps of:

a. electrodepositing a layer of wear resistant material on to a core;
b. immersing said layer of wear resistant material in an aluminium containing melt to form an intermetallically combined aluminium layer;
c. casting an aluminium alloy around the aluminium layer in a pressureless manner to form a composite casting on said core; and
d. detaching said composite casting from said core, wherein during a final phase of the electro-depositing process, the current density is increased in such a way that the deposited layer has a roughened-up surface.

The result is a surprisingly rough surface, whereby the surrounding aluminium is given, in addition to the metallic bonding, the possibility of being clamped mechanically. Advantageously, the current density should exceed by 25 % that density at which it is still possible to manufacture layers that are just about smooth. During the final phase, when the current density is increased, there should still be deposited approximately 0.3 to 0.6 mm of a rough layer forming the outer surface. A rough surface can also be achieved by using an anode which is formed with corresponding depressions.

DESCRIPTION OF PREFERRED EMBODIMENTS

The invention will be explained with reference to three exemplified embodiments:

EXAMPLE 1

A steel core is electro-deposited with a nickel dispersion layer. As a result, one obtains from a nickel bath containing 240 g/l nickel sulfate, 45 g/l nickel chloride, 30 g/l boric acid and having a pH-value of 5 and a bath temperature of 35°C, along with vigorous moving of the bath, layers which are still smooth up to the cathode current density of 9 A/dm². The desired roughness comes about at a current density of 11 A/dm². During the increase in the current density, a rough outer layer of 0.3 to 0.6 mm is applied on a smooth layer having a thickness of, for example, 0.3 mm.

Subsequently, the coated core is immersed at approximately 550° C for 3 minutes in a deoxidation or flux medium melt which has, for example, the following composition:

40 % MgCl
35 % KCl
20 % CaF
5 % NaCl.

The core, which has been coated with the thus treated, electro-deposited nickel-dispersion layer, is immersed at 670° C for 2 minutes in an aluminium melt containing 5 % Si and is introduced into the mould of a casting installation immediately afterwards. The layer obtained through the immersion has a thickness of approximately 0.05 mm. After an aluminium alloy containing 12 % Si, approximately 1 % Ni and approximately 1 % Cu has been cast around, the core, which is cooled by water after the casting process, is pulled out in virtually any desired thickness. The nickel-dispersion layer then is exposed towards the interior, whilst the outer surface of this layer, which adjoins the aluminium, forms an intermetallic bonding therewith. The treatment with a deoxidation agent can be dispensed with.

EXAMPLE 2

When a rapid nickelling bath containing 600 g/l nickel sulphamate, 5 g/l nickel chloride and 40 g/l boric acid and having a pH-value of 4 and a temperature of 50° C is used, the current density that should preferably be applied is at least 50 A/dm².

I claim:

1. A method for manufacturing a composite casting, comprising the steps of:

a. electrodepositing a layer of wear resistant material on to a core;
b. immersing said layer of wear resistant material in an aluminium containing melt to form an intermetallically combined aluminium layer;
c. casting an aluminium alloy around the aluminium layer in a pressureless manner to form a composite casting on said core; and
d. detaching said composite casting from said core, wherein during a final phase of the electro-depositing process, the current density is increased in such a way that the deposited layer has a roughened-up surface.

2. The method according to claim 1, wherein the current density increase during the final phase of the electro-depositing process is at least 25%.

3. The method according to claim 1, wherein during the final phase, when the current density is increased, at least 0.3 to 0.6 mm of a rough layer are still electro-deposited.

4. The method according to claim 1, wherein in order to achieve a rough surface, an anode comprising corresponding depressions is used on the layer that is to be electro-deposited.

* * * * *